US005468205A

United States Patent [19]

McFall et al.

[11] Patent Number: 5,468,205

[45] Date of Patent: Nov. 21, 1995

[54] PORTABLE DOOR MOUNTED EXERCISE APPARATUS

[76] Inventors: Michael McFall, 130 Manzanita La., Thousand Oaks, Calif. 91360; Paul Aagaard, 458 Havenside, Newbury Park, Calif. 91320

[21] Appl. No.: 333,608

[22] Filed: Nov. 2, 1994

[51] Int. Cl.[6] ..... A63B 21/04

[52] U.S. Cl. ..... 482/129; 482/121; 482/904

[58] Field of Search ..... 482/121, 123, 482/122, 126, 129, 904, 125

[56] References Cited

U.S. PATENT DOCUMENTS

| | | | |
|---|---|---|---|
| 679,784 | 8/1901 | Ryan | 482/129 |
| 680,556 | 8/1901 | Wieland | 482/129 |
| 689,418 | 12/1901 | Ryan | 482/129 |
| 760,374 | 5/1904 | Belvoir | 482/129 |
| 3,118,441 | 1/1964 | George . | |
| 4,611,805 | 9/1986 | Franklin . | |
| 4,685,670 | 8/1987 | Zinken . | |
| 4,830,365 | 5/1989 | March . | |
| 5,029,850 | 7/1991 | van Straaten | 402/125 |
| 5,221,240 | 6/1993 | Mann . | |

FOREIGN PATENT DOCUMENTS

| | | | |
|---|---|---|---|
| 2257921 | 1/1993 | United Kingdom | 482/129 |

*Primary Examiner*—Lynne A. Reichard

*Attorney, Agent, or Firm*—Patent Law & Venture Group; Gene Scott

[57] ABSTRACT

An exercise apparatus is disclosed having a pair of pulley support units mounted on a door by straps which vertically encircle the door. The support units are interconnected by a series of elastic bands, such as bungee cords that run vertical paths between the support units. The ends of the bands or cords are wrapped around pulleys and terminated such that a handle may be attached to each of the cords at either the top unit or the bottom unit. Various exercises are possible with one or two arms or legs by pulling on the cords with the handle. The apparatus is easily mounted or dismounted from any door or other vertically oriented and fixed-in-place partition and is small enough to fold and store in a small carrying case.

6 Claims, 3 Drawing Sheets

PORTABLE DOOR MOUNTED EXERCISE APPARATUS

FIELD OF THE INVENTION

This invention relates generally to exercise equipment and more particularly to a compact, lightweight, portable exercise apparatus that operates with a series of resistance bands and pulleys and is easily secured to any door, thereby allowing the user to perform a wide variety of both cardiovascular and muscle strengthening exercises at a convenient time and location.

BACKGROUND OF THE INVENTION

Invention and use of portable and home use exercise machines is known to the public. In recent decades, as the awareness of the importance of cardiovascular and muscle training has risen, so too has the demand for increased and improved exercise equipment. While gyms and health clubs typically offer a variety of sophisticated and expansive equipment, such clubs are often undesirable because of distance from the user or high membership fees. And, even those who are members of such a facility do not always have the time or energy to visit the club, even when a workout is desired or needed. Further, the public has become more aware that consistent and intelligently applied exercise can lengthen lifespan, overcome physical disfunction and provide other related advantages. Thus, there is an ever-growing demand for versatile, affordable and effective exercise equipment that can be easily utilized at home, in the office, while on vacation or at any number of other locations.

One of the original home exercise apparatuses was introduced by I. P. George in U.S. Pat. No. 3,118,441 issued in 1964. This device is bracketed to the top of a door and has two vertical bars that extend above the door frame. A pulley on each bar accepts a cable with a handle on the end. When a chair or the like is placed against the door, the user can sit on the chair, grasp the handles and pull them downwardly to perform several different arm strengthening exercises. However, this design has several problems. First of all, it makes no accommodation for variable heights of the chair or user. Thus, there is an increased chance that the user will be unable to effectively work the desired muscles properly. In addition, the device is not compact or easily portable, and therefore not conveniently relocated when desired.

Perhaps the most serious downfall George is that it is only capable of engaging a limited range of muscle groups, notably the biceps and deltoids, and therefore incapable of providing a complete workout. This is a serious drawback because when some muscle groups are regularly engaged while others are left relatively inactive, the possibility of muscle strain or injury is greatly increased, as the weaker muscle groups cannot sustain the force that the opposing, stronger groups are capable of accommodating.

U.S. Pat. No. 4,685,670 issued to Harlod Zinkin in 1987 is an exercise apparatus using an elastic or spring type resistance with a multiple pulley arrangement attached to elastic rubber straps to provide tension on a cable that is threaded through openings in an elongated housing. An external hand grip is secured to one end of the cable to be grasped or otherwise engaged by the user. A significant problem with this invention is that it only provides one handle, thus allowing only one arm to be exercised at a time and thereby requiring more time to a complete exercise program. In addition, this configuration, like George, allows the user to participate in a very limited number of exercises utilizing a limited number of muscles groups.

Thus, to remedy the significant defects of these muscle-specific devices, several exercise devices were designed to attach to a door in two different directions, thereby allowing the device to be employed in a greater number of exercises and engage a greater number of muscle groups. One such invention, introduced by Irving Franklin et al. in U.S. Pat. No. 4,611,805, issued in 1986, is composed of a support bracket that secures the device to the top, or alternately the bottom, of a door or bed frame. A T-shaped exercise bar extends horizontally from the bracket, but may be secured in several other positions angled from the bracket. Heavy elastic cords extend from the exercise bar to a pair of handles. When the device is secured to the bottom of the door, the handles are upwardly moveable, and when it is secured to the top of the door they are downwardly moveable.

U.S. Pat. No. 4,830,365, introduced by Craig March in 1989, hooks to the top and bottom of a door. In one position, a vertical containment housing is located near the top of the door, with a spring extending vertically downward from within it. A molded piston assembly is slidably disposed within the containment housing and includes a fastening device that secures the lower end of the spring and a rope. The rope is threaded through a pulley near the bottom of the door and extends outwardly from it, and has a handle attached to the rope end for gripping and pulling. Thus, in this position, exercises in which the rope is pulled outward or upward, such as a leg raise or a biceps curl, can be performed, and when the rope is pulled the spring is extended downwardly. The device can alternately be positioned so that the pulley is at the top of the door, and the containment housing is near the bottom, thus accommodating exercises which require downward pull, such as lateral muscle (or lat) pulldowns or triceps extensions. In this position, force on the rope causes the spring to extend upward.

The apparatus of U.S. Pat. No. 5,221,240 issued to Karen L. Mann in 1993 can also be placed into two positions to allow maximum access to all the muscle groups. This invention is supported in a doorway or hallway by means of a telescoping frame network that can extend or contract to fit in the desired space. The end of each telescoping member includes friction pads that engage the wall's surfaces. Two tether lines are engaged with elastomeric webs at the bottom of the frame and extend upward through guide loops at the top of the frame. The ends of the lines extend downwardly and include handles which may be employed to engage in lateral (or lat) pulldowns and other downward pulling exercises. To perform upward pulling exercises, the device can be inverted so that the elastomeric webs are at the top part of the frame and the guide loops are at the bottom.

There are many problems with this device. First of all, while the telescopic framework provides some benefits in being able to accommodate different sized doors and halls, it also provides a mounting system that is not firmly securable, and too much force could indeed knock it from its position. In addition, this system utilizes guide loops instead of pulleys. This does not provide the smooth action pulleys are capable of providing. In addition, this results in a great deal of strain on the loops, thereby wearing them faster and causing more frequent repair.

Most importantly, however, none of the above related prior art is capable of conveniently providing a comprehensive workout to all the muscle groups. While they may be removed from the door and repositioned so as to accommodate opposing muscle groups, this is a time consuming process, and is especially undesirable in conjunction with weight lifting programs that include set rotations that frequently alternate between downward and upward pulling exercises. In addition, none of the prior art is capable of allowing for not only muscle strengthening exercises, but also cardiovascular exercises as well. Still further, while all of the prior art claims to be portable, the majority of it is not truly, easily portable in a suitcase or the like and a good portion of it requires significant set-up or break-down time. Thus, while these inventions are technically portable, in reality they are more likely employed for use in a single location.

Thus, there is a need for a truly lightweight, portable exercising device that allows all muscle groups to be worked without requiring reconfiguration of the device and further allows for cardiovascular exercise. The present invention fulfills these needs and provides further related advantages as described in the following summary.

SUMMARY OF THE INVENTION

The present invention is a portable exercise machine that easily attaches to any door. Thus, it is an object to provide an exercise machine that can provide a complete workout from the user's own home, office or the like.

The invention consists of four variable resistance bands, each guided by its own independent, omnidirectional pulley system, two push/pull handles that also convert to leg attachments, and door mounting straps. Thus, it is an object of the invention to include few parts and take up a relatively small amount of space, even when in use, thereby providing a machine that is unobtrusive and can be utilized in even the smallest office or living spaces.

A bracket that seats four pulleys, each with a resistance band, is secured to the top of the door, and an identical one is secured to the bottom of the door so that the resistance bands are stretched between the two. Two straps made of high strength nylon webbing extend from each bracket. The straps are guided over the top of the door and underneath the bottom of the door respectively. The bottom straps are threaded through the D-rings attached to the top straps and pulled downwardly to tighten and thus position the brackets at the top and bottom of the door with the resistance bands stretched tautly between them. The bottom strap ends are then secured with Velcro fastening material or the like. Thus it is an object of the invention to be extremely easy and speedy to assemble and disassemble, thereby improving its portability. It is also an object of the invention to be extremely lightweight, approximately seven pounds, thus further adding to its portability.

Each end of each resistance band includes an O-ring. These rings not only keep the bands from disengaging with the pulleys, but they also provide means for a handle to be clipped onto the band. Thus, to alternate from overhead pulling exercises to upward pulling exercises, or from arm to leg exercises, the handles are simply unclipped and replaced at the alternate end of the band. It is therefore an object of the present invention to improve over all prior art by providing a means to rapidly and conveniently work alternate muscle groups without requiring repositioning of the device.

In addition, by hooking the handles to the resistance bands in different combinations, eight degrees of tension can be obtained. Increasing and decreasing the user's distance from the machine also varies the overall resistance. It is thus an object of the invention to provide several different levels of resistance for the user.

In addition, it is an object of the invention to provide variable dynamic resistance so that the resistance is tailor fit to accommodate the users strength range, thereby maximizing the workout of the beginner or the advanced bodybuilder. This is accomplished because as pressure is applied to the bands via the handles, the pulleys smoothly distribute the power of the bands so that tension remains constant and even over the entire range of motion. Further, the bands are dynamic, and the more the bands are stretched, the more resistance they provide.

The invention's dynamic variable resistance also provides therapeutic value to the user's body. When using free weights, as the muscle contracts the resistance lessens. However, with the present invention, when the muscle contracts the resistance increases. When the muscle returns to its resting or uncontracted position, the resistance bands are also very nearly at rest, which results in little or no pressure on the joints. Thus it is an object of the invention to allow the body to recover better from intense exercise and decrease the chance of injury It is another object of the invention to alternately or additionally include other attachments, such as a wide-grip bar or a T-bar, to be used instead of the handles to accommodate exercises, such as the bench press and lateral (or lat) pulldowns, that require other gripping configurations.

It is another object of the invention to utilize a pulley and bearing system so that a smoother range of motion is provided and the life of the moving parts is extended.

It is also an object of the invention to be of simple construction so as to lower manufacturing costs and thereby provide the consumer with a very affordable portable home exercise machine.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
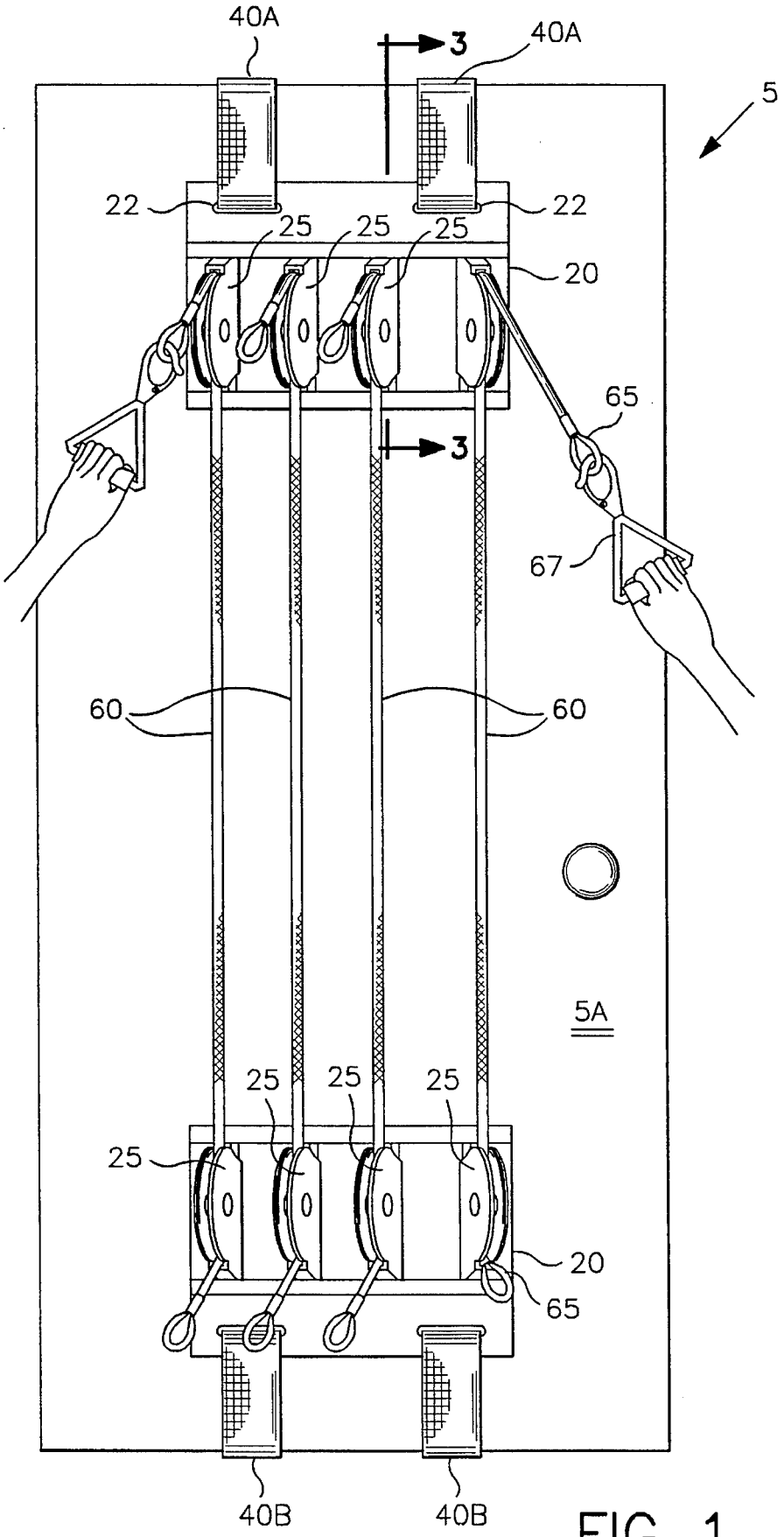
FIG. 1 is a front elevational view of the invention, particularly showing how the invention is attached to a door, and the elastic band routing of the invention.

FIG. 1 shows a door-mounted exercise apparatus designed to be mounted on any door, thereby facilitating a complete body work-out at any remote location that has a door 5. The apparatus is compact and does not require a great deal of space to operate, and therefore can be used in very small apartments and the like. The apparatus is also light weight, and easy to assemble and disassemble, making it extremely convenient to transport and relocate.

The apparatus includes identical upper and a lower bases 20 that contact a front vertical surface 5A of the door 5 in mutual vertical alignment one above the other. It also includes two pairs of corresponding mounting straps 40A, 40B leading from the bases 20 to the door's back surface 5B to secure the apparatus firmly against door 5, and a plurality of elastic cords 60 extending between the bases 20, providing tension between them.

Each base 20 has a plurality of pulley holders 25 that are pivotally mounted by pivot pins 25A to the base 20 in side by side alignment, and are therefore free to swivel from side-to-side. Each holder 25 provides a rotatable, vertically mounted pulley 30 that freely rotates within the holder 25 around a central axel 30A. This allows exercises to be performed at all lateral angles from the door 5 in that as cords 60 are pulled the pulley holders 25 pivot in the direction of the pull. The pivot pins 25A are preferably oriented at an off-vertical angle and which has been found to operate best at between 10 and 20 degrees with 15 degrees being preferred on most doors. This off-vertical tilt is critical to proper action of the pulley holders and in order to assure that base 20 remains in contact with door surface 5A.

The mounting straps 40A, 40B are attached to each of the bases 20 by an attachment means 22 integral with the bases 20, to hold them against the front surface 5A of the door 5. Preferably, the attachment means 22 consists of several slots, each accepting a mounting strap 40A or 40B. One portion of each of the straps 40 extends through the corresponding slot, forming an acute angle 23 around the base 20. By keeping the straps 40A, 40B at an acute angle 23 around the base, the straps 40 effectively hold the base 20 against the front door surface 5A. This is crucial, as many of the exercises performed with the apparatus put large forces on base 20 which tend to pull the base 20 away from the door 5, and the acute angle 23 of the straps 40A, 40B allows them to at least partly counterbalance these outwardly directed forces and keep the bases 20 firmly in place against the door 5.

Figure 2:
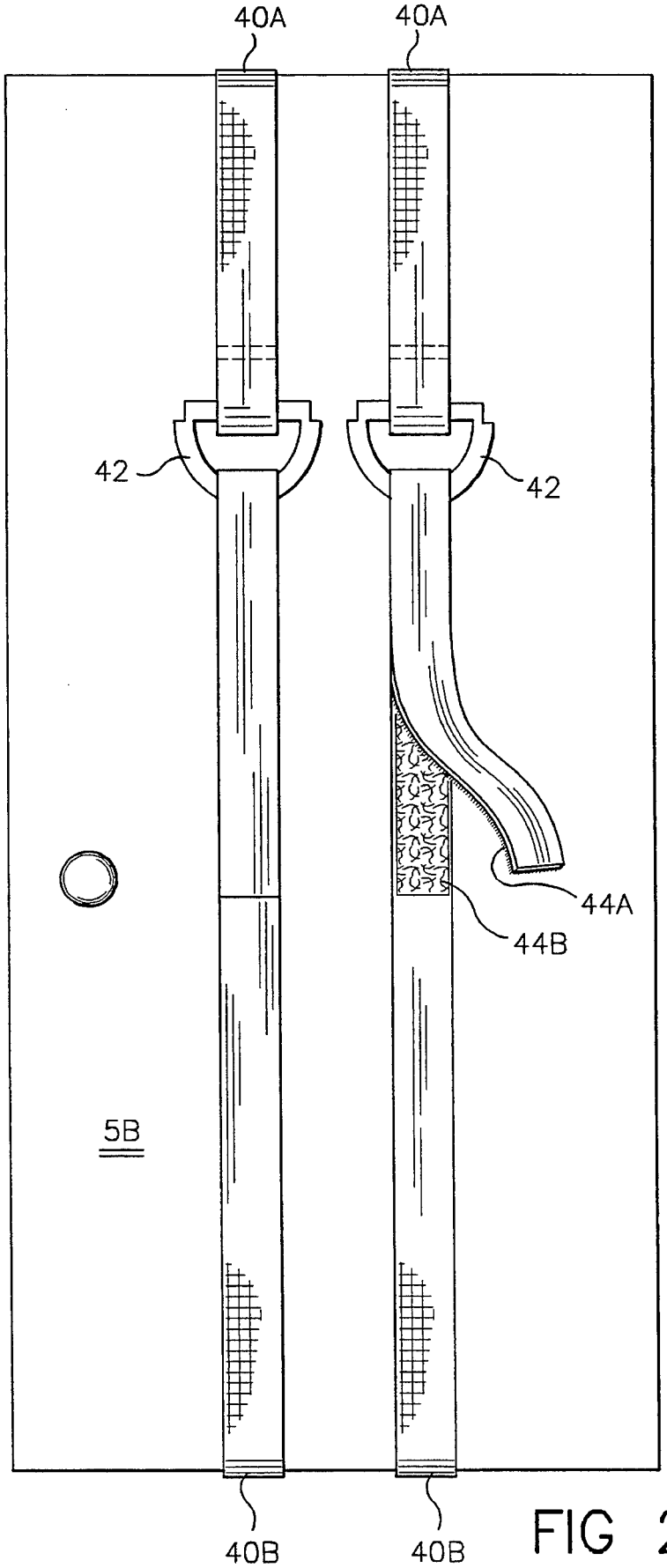
FIG. 2 is a rear elevational view of the invention showing further door attachment details.

When the mounting straps 40A and 40B are secured through the attachment means 22 of the bases 20, the straps 40A, 40B lay against the door's front surface 5A, and extend around the upper and lower edges of the door respectively. A shown in FIG. 2, the pairs of mounting straps 40A, 40B mutually join together in such a way on the back surface of the door 5B that the straps 40A, 40B are in tension on the door 5. The straps 40A, 40B are preferably joined by means of a buckle 42 terminating straps 40A, and a two part fastening means 44A and 44B on the terminal end portion of straps 40B. One of each pair of the straps 40A terminates with the buckle 42 and the other straps 40B of each pair terminates in the two part, hook and loop fastening means 44A, 44B, such that these mounting straps 40A, 40B may be looped through the buckle 42, pulled into tension and fastened for holding the apparatus on the door in such manner that severe pulling on the elastic cords during exercise does not pull the bases 20 away from the door front surface 5A.

Figure 3:
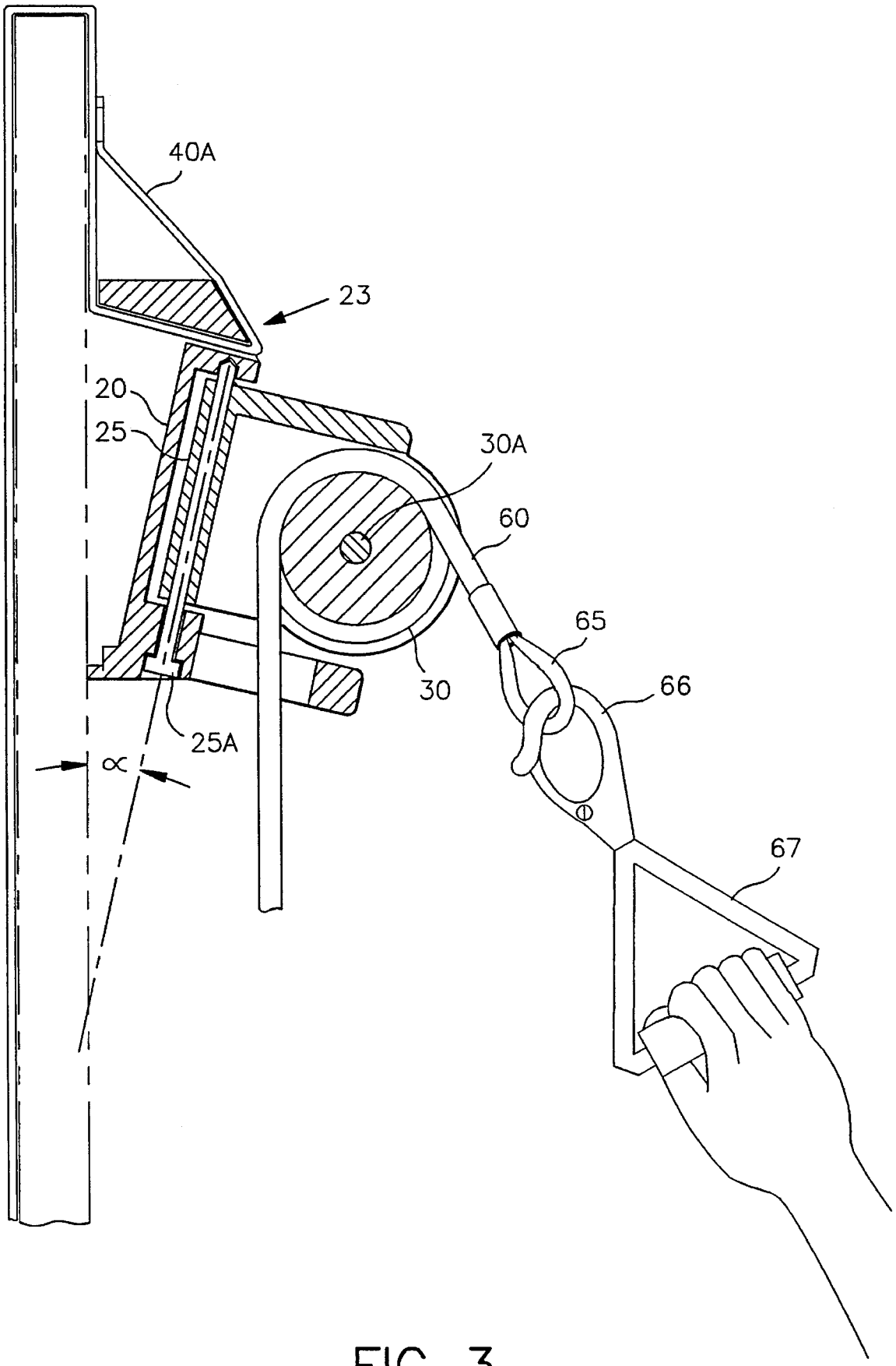
FIG. 3 is a cross-sectional view taken along lines 3—3 of FIG. 1 showing the base and pulley assembly and further details of the elastic bands of the invention.

The plurality of elastic cords 60 extend between the two bases 20 and are under tension as previously explained, thereby helping to hold the bases 20 in position against the surface 5A. As illustrated in FIG. 3, each of the cords 60 is wrapped around one pulley 30 in the upper and lower bases 20, completing at least 90 angular degrees of wrap around each of the pulleys 30. The amount of wrap of the cords 60 around the pulleys 30 depends on the height of the person exercising, the position of the exerciser, the type of exercise, the height of the door, and the position of the bases 20 on the door. The ends of the cords 60 extend away from the front door surface 5A, so that the cords 60 are easily accessible and can be pulled outwardly away from the door 5 during use. The ends of the cords 60 terminate in an attachment joint 65 that is too large to fit between the pulley 30 and the holder 25, thereby preventing the cords 60 from falling off the pulleys 30 and keeping the cords 60 in tension between the bases 20. At least one handle 67 is provided, the handle 67 having attachment means 66, such as a hook, for engaging the attachment joint 65, preferably an eyelet, of any one of the cords 60. The handle 67 is of a convenient size and shape for grasping, and the attachment means 66, can be easily removed from one pulley attachment joint 65 and quickly reattached to another one, two, or even more of the cords 60 for changing exercises and resistance's. Preferably, a plurality of handles 67 are included, providing different gripping surfaces for different types of strengthening exercises and including grips for both hands and feet as well as for other parts of the body.

When the handle 67 is secured to an attachment joint 65, the handle is pulled to extend the corresponding cord 60. This provides resistive exercise. To accommodate various strength and skill levels for progressive resistance exercising, at least two of the elastic cords 60 differ in spring constant, so that some cords 60 provide greater resistance than others. As the user's strength increases, the cords 60 can be replaced with cords 60 with a greater resistance.

With the embodiment described above, there are countless exercises that can be performed to work various muscle groups. The following are examples and explanations of various exercises that can easily be performed with the exercise apparatus to target the specified muscle groups.

LOWER ABS/EXTERNAL OBLIQUES

Hyperextensions. Sit facing door, hold handles off top pulley, lean back and extend back to lightly touch the floor, crunch abs as return to starting position.

Bicycle trunk twists, Attach cables to feet and twist legs while bicycling.

Cable leg lifts. Attach lower pulley cables to legs, sit facing door, lean back 45 degrees on hands and bring legs into stomach while exhaling.

Standing leg raises. Attach lower pulley cables to leg, facing away from door, lean back, bring knee up to chest while exhaling and crunching stomach, alternate legs.

Lying leg lifts. Attach lower pulley cables to legs, lie on back, sit on hands, raise torso to crunch while raising legs straight up to 45 degrees.

Reverse crunches. Lie flat on back, hands at sides on floor, legs lifted and bent 90 degrees, lift hip up and back toward head, keep shoulders on floor.

UPPER ABS

Front Crunches. Kneel or stand, facing or back to door.

Side Crunches, Kneel or stand sideways at 45 degree angle, facing or back to door.

CHEST

Bench Press. Stand, back to door, push straight out from top pulley.

Decline Press. Stand, back to door, push down 45 degrees from top pulley.

Incline Press. Kneel or stand, push up 45 degrees form bottom pulley.

Flyes. Stand, back to door, bring arms together in front of chest from top pulley.

Decline Flyes. Stand, back to door, bring arms down 45 degrees and together in front of chest from top pulley.

Incline Flyes. Stand, back to door, bring arms up 45 degrees together in front of chest from bottom pulley.

BACK

Front lateral (or lat) pulldown. Sit or kneel, facing door, pull down from top pulley.

Behind neck lateral (or lat) pulldown. Sit or kneel, facing door, pull down to behind neck from top pulley.

Seated row. Sit, and with one or two hands, pull from top or bottom pulley.

One arm bent over row. Stand or put one knee on chair, pull from bottom pulley.

SHOULDERS

Military press. Back to door, begin seated in chair, then stand to finish to increase resistance.

Front deltoid press. Stand facing door, elbows slightly bent, alternately raise arm up and parallel to the floor.

Side lateral deltoid raise. Stand sideways, elbows slightly bent, raise arm to shoulder height parallel to floor.

Rear deltoid. Bend at waist so torso parallel to floor, elbows slightly bent, pull arms back.

Upright Row. Stand facing door.

BICEPS

Curl. Stand, brace elbow against hip, curl arm, reverse.

Preacher curl. Kneel facing door and place elbow on chair, curl, reverse.

Cable curl. From top pulley, stand sideways, extend arm straight out and curl to shoulder; from bottom pulley, sit on chair sideways.

Concentration curl. Sit on chair or bend over, use knee.

TRICEPS

Standing overhead extensions

Push downs.

Close grip bench press.

Triceps kickbacks. From bottom pulley.

LEGS

Hack Squats. Face door, handles under chin.

Squats. Back to door, handles up to shoulders.

Lunges. Face door, hold handles at side, step forward toward door.

Leg curl. Lie flat on stomach with feet toward door, curl leg.

Calf Raises, Face door, stand on phone book with handles under chin.

CARDIOVASCULAR

Jogging. Back to door, cables attached to waist from bottom pulleys, run in place.

Jogging with upper body. Same as above, use top handles for arm workout.

Advanced jogging. Run with bottom cables attached to legs while using top handles for arms.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. An exercise apparatus for mounting on a door, the exercise apparatus comprising:

identical upper and lower bases adapted to be in contact with a front vertical surface of a door in mutual vertical alignment one above the other, each of the bases providing a plurality of pulley holders each pivotally mounted to the base in side by side alignment with free lateral turning thereon, each of the holders having a rotatably, vertically mounted pulley, freely rotatable within each of the holders such that the pulleys in the upper base and the pulleys in the lower base form corresponding vertically aligned pairs of pulleys, each of the bases further including attachment means for holding the base against the front vertical surface of the door;

at least one pair of mounting straps, each of the straps attached to the attachment means of the upper and lower bases, the straps being adapted to lay against the front vertical surface of the door, and to extend around the upper and lower edges of the door, and being capable of being mutually joined together on a rear surface of the door so that the straps are capable of being in tension on the door;

a plurality of elastic cords, each of the cords extending between the corresponding pairs of pulleys, each of the cords being wrapped around one pulley in the upper base and one corresponding pulley in the lower base and completing at least 90 angular degrees of wrap around each of the pulleys so that the ends of the cords are capable of extending away from the door front surface, the ends of the cords terminating in an attachment joint, each joint having a size unable to fit between its respective pulley and holder so that the cords are placed under tension when holding the bases in position on the door; and at least one handle having attachment means for engaging the attachment joint of any one of the cords.

2. The apparatus of claim 1 wherein the attachment means of each of the bases includes at least one slot for accepting the mounting straps therethrough, one portion of each of the straps extending through the at least one slot, forming an acute angle around the base for holding the base against the front door surface.

3. The apparatus of claim 1 wherein at least two of the elastic cords differ in spring constant thereby providing a means for progressive resistance exercising.

4. The apparatus of claim 1 wherein one of the mounting straps terminates in a buckle, the other of the mounting straps terminates in a two part fastening means such that the other of the mounting straps may be looped through the buckle, pulled into tension and fastened to itself for holding the apparatus on the door.

5. The apparatus of claim 4 wherein the two part fastening means is a hook and loop fastener.

6. The apparatus of claim 1 wherein each of the pulley holders is pivotally supported by a pivot pin positioned at an angle of between 10 and 20 degrees off-vertical allowing the pulley holders to pivot laterally when acted upon by a non-horizontally directed pull force.

* * * * *